US005231947A

United States Patent [19]

Kasahara et al.

[11] Patent Number: 5,231,947

[45] Date of Patent: Aug. 3, 1993

[54] SHIP'S RUDDER

[75] Inventors: Yoshikazu Kasahara; Yukihiko Okamoto, both of Kawasaki, Japan

[73] Assignee: NKK Corporation, Tokyo, Japan

[21] Appl. No.: 676,975

[22] Filed: Mar. 28, 1991

[30] Foreign Application Priority Data

Jul. 27, 1990 [JP] Japan ..... 2-197691

[51] Int. Cl.[5] ..... B63H 25/06

[52] U.S. Cl. ..... 114/162

[58] Field of Search ..... 114/162, 166, 140, 127, 114/128; 244/199, 91

[56] References Cited

U.S. PATENT DOCUMENTS 4,050,397 9/1977 Vanderleest ..... 244/91 X 4,653,418 3/1987 Mori et al. ..... 114/162

FOREIGN PATENT DOCUMENTS 0278499 12/1986 Japan ..... 114/162

41572 6/1925 Norway ..... 114/162

OTHER PUBLICATIONS

Aerodynamics, Aeronautics, and Flight Mechanics pp. 214–219 ©1976.

*Primary Examiner*—Edwin L. Swinehart

*Attorney, Agent, or Firm*—Fleit, Jacobson, Cohn, Price, Holman & Stern

[57] ABSTRACT

A ship's rudder has a main rudder body with a cross-sectional shape that is streamlined and symmetrical relative to the vertical center plane of the rudder. A pair of fins extend horizontally from opposite vertical surfaces of the rudder body, symmetrically arranged relative to the center plane of the rudder. The chord length of each fin decreases from a root of the fin toward the tip of the fin. The leading edges of the fins coincide at the center plane of the main rudder body, and are located at the same level as the center line of a propeller of the ship. The fins have winglets on their tip ends. One of the winglets is directed upwardly and the other winglet is directed downwardly.

3 Claims, 4 Drawing Sheets

SHIP'S RUDDER

BACKGROUND OF THE INVENTION

1. Field of the Invention

The present invention relates to a ship's rudder.

2. Description of the Related Art

As means for enhancing a propulsive efficiency of a ship, Japanese Patent Publication Laid Open No. 15895/72 discloses the provision of a fin extending horizontally from each side of a rudder body, the fins symmetrically mounted relative to the center plane of the rudder, whereby rotational energy in a propeller slip stream is recovered and converted to a forward thrust. A fin of an improved form is disclosed in Japanese Utility Model Publication Laid Open No. 28000/90. In this example, as shown in FIGS. 5(A) to (C) herewith attached, a leading edge of a rudder 1 coincides with a leading edge of a fin 2 on the center line of the rudder 1, and the leading edge of the fin has a sweepback angle of $\theta$. The chord length of the fin 2 is set so that the length lr at the root of the fin is one and a half times the length lt at the tip of the fin, or more, and a plane form of taper fin, wherein the chord length of the fin decreases from the above-described root of the fin toward the tip of the fin is adopted.

In the form of fin of the above-described prior art rudder, the leading edge of the fin has a sweepback angle of 20° to 50°, and the plane form of the taper fin, wherein a fin span decreases as it comes near to the tip of the fin, is adopted. In consequences, when an inflow attack angle of a current flowing into the fin is regarded as large to some extent, a strong fin tip vortex tends to occur at the vicinity of the fin tip compared with a case where a fin has a plane form without any sweepback angle. (see FIG. 6).

The inflow attack angle ($\alpha t$) at the fin tip is decreased ($\alpha t < \alpha r$) by an induced velocity of the strong fin tip vortex, whereby lift caused to the fin is decreased and drag (referred to as an induced drag) is increased. Accordingly, thrust, which is caused by the fin and which is a forward component of the lift, is decreased, with an adverse affect on propulsive efficiency.

SUMMARY OF THE INVENTION

The present invention is intended, at least to an extent, to solve the above-described problem. It is an object of the present invention to provide a rudder structure which enhances the propulsive efficiency of the rudder by decreasing the induced drag of the fin by diffusing and weakening the vortex generated from the aforementioned fin tip and by utilizing some of energy of the fin tip vortex, which rotates fluid, as forward thrust.

To attain the above-mentioned object, the present invention provides a ship's rudder, comprising:

a main rudder body, the sectional shape of which is streamlined and symetrical relative to the vertical center line thereof;

a pair of fins horizontally extending from opposite vertical surfaces of the rudder body and symmetrically arranged relative to the center plane; and a winglet attached to the outer ends of each of said pair of fins.

Other objects and advantages of the present invention will become apparent from the following detailed description, taken in conjunction with the appended drawings.

BRIEF DESCRIPTION OF THE DRAWINGS

FIG. 3 (B) is a top plan view of the rudder and the surrounding ship parts;

FIG. 3 (C) is a side elevation showing only the rudder seen from the rear;

FIG. 5 (B) is a top plan view showing the prior art rudder and its surrounding ship parts;

FIG. 5 (C) is a side elevation showing only the prior art rudder seen from the rear.

DESCRIPTION OF THE PREFERRED EMBODIMENT

The winglet at the tip of the fin in the present invention diffuses a strong fin tip vortex, which is generated from the tip of an energy saving fin mounted on a rudder and which extends in a rolled-up vortex filament toward the downstream, in the plane form. Thereby, the attack angle even at the tip of the fin is not decreased, and the induced drag of the fin is decreased. Due to this effect, the lift generated in a fin body is increased, and the thrust as the forward component of the lift, which is generated on the fin, also is increased.

Further, since there is a rolled-up flow from the side of a positive pressure to the negative pressure side around the tip of the fin, an inflow into the winglet at the tip of the fin becomes a flow from the outside of said winglet at the tip of the fin to the inside thereof. The lift is generated on the winglet itself by adopting a blade section in the winglet at the tip of the fin, and the forward component of the lift is converted to thrust. Since a flow, which has components directed toward the hull center line under the influence of a hull positioned forward, is dominant due to the position of the rudder of a ship, the flow further increases the thrust generated by the winglet itself.

An embodiment of the present invention will now be described with specific reference to the appended drawings of FIGS. 1 to 4 of the drawings.

Figure 1:
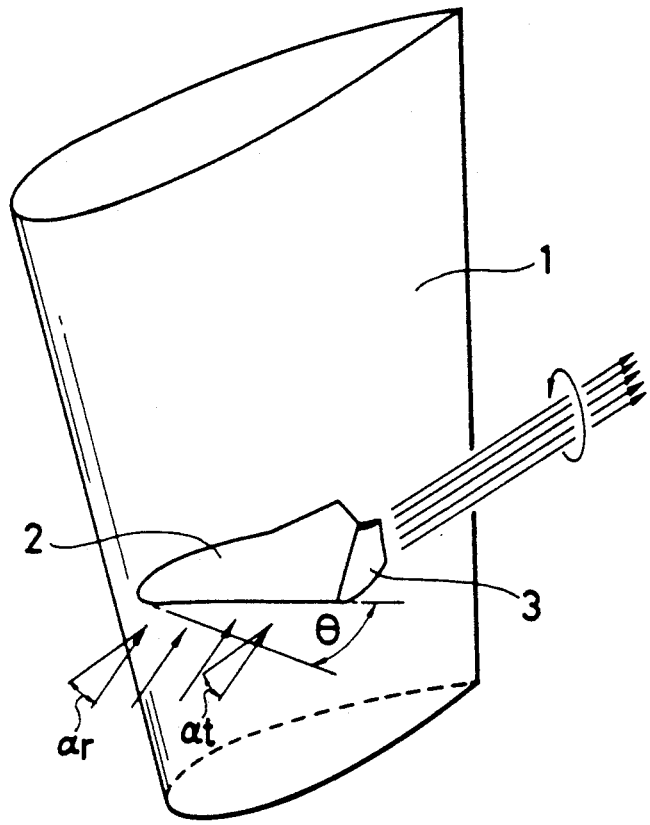
FIG. 1 is a perspective view of a rudder according to the present invention.

FIG. 1 is a perspective view showing a rudder relative to the right-handed turning propeller, which is seen from the forward side of the starboard and shows the principle of the present invention.

In the drawing, reference numeral 1 denotes a rudder body, which is positioned in a propeller slip stream. A fin 2 extending in the horizontal direction is mounted on said rudder 1 on the horizontal plane passing through the center of the propeller as in the prior art rudder.

Fin 2 has a sweepback angle of $\theta$ at the leading edge thereof. A winglet 3 extending in the longitudinal direction (in the upward direction in the example as shown in FIG. 1) is mounted on the tip of the fin 2.

In the case of the fin 2 having such winglet 3, a vortex at the tip of the fin 2 is depressed and weakened by the above-mentioned winglet 3 and thereafter flows in the form of a plane.

Accordingly, the attack angle $\alpha_t$ at the tip of the fin is not much decreased. There is little difference between the attack angle $\alpha_t$ and the attack angle $\alpha_r$ at the root of the fin. The lift generated on the fin 2 yet obtains the forward component, that is, the thrust.

Figure 2:
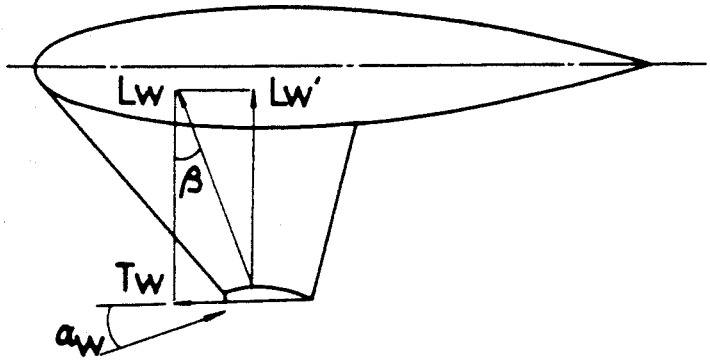
FIG. 2 is a top plan view of the rudder showing a fin on one side of the rudder.

Since the winglet 3 has an attack angle $\alpha_W$ due to a converging flow along the hull form of the stern, a lift $L_W$ having a forward component $T_W$ as shown in FIG. 2 is generated. Such forward component $T_W$ is converted to thrust.

As described above, in the present invention, the thrust at the tip of the fin 2 is not decreased. Moreover, a new or additional thrust can be obtained on the winglet 3. Thereby, the propulsive efficiency of the rudder is increased. It was confirmed in a tank test that horse power was decreased by about 2% independent of the ship load conditions.

Figure 3:
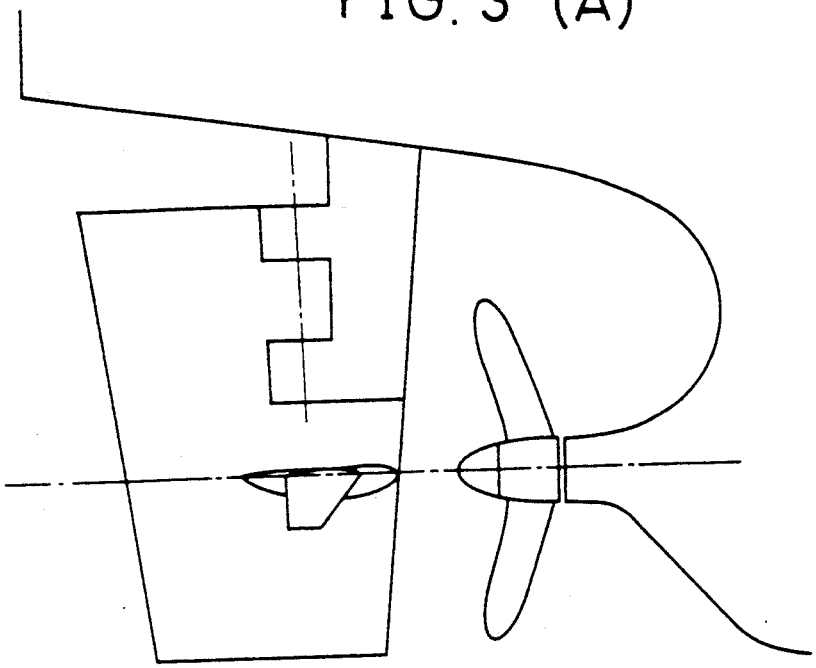
FIG. 3 (A) is an elevation view of the rudder and surrounding parts of a ship.
Figure 3:
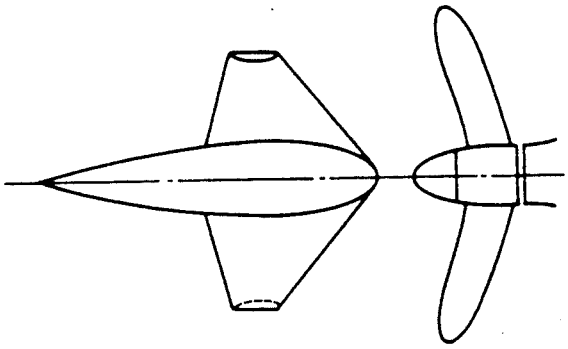
Figure 3:
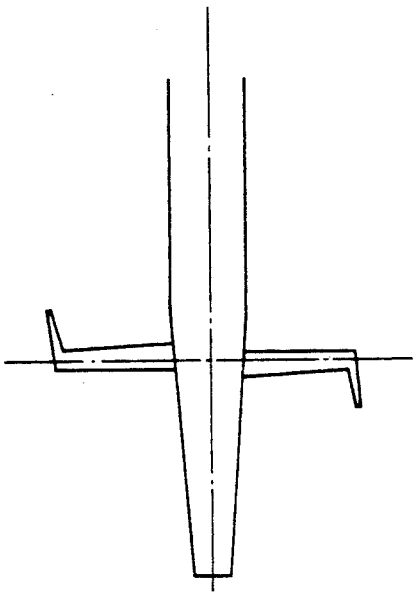

The above-mentioned winglet has an effect in any of the upward direction and downward direction relative to the fin. For example, as shown in FIG. 3 (A) to (C), taking into consideration that cambers of the fin are reversed on the starboard and on the port side, the winglet can produce the symmetrical effects to the left and the right by causing the cambers to extend in a certain direction.

Figure 4:
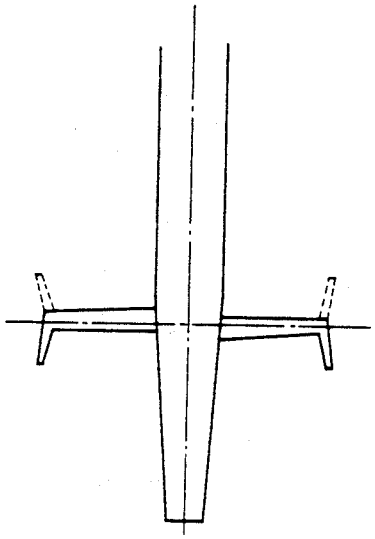
FIG. 4 is a side elevation showing another example of the rudder according to the present invention.
Figure 5:
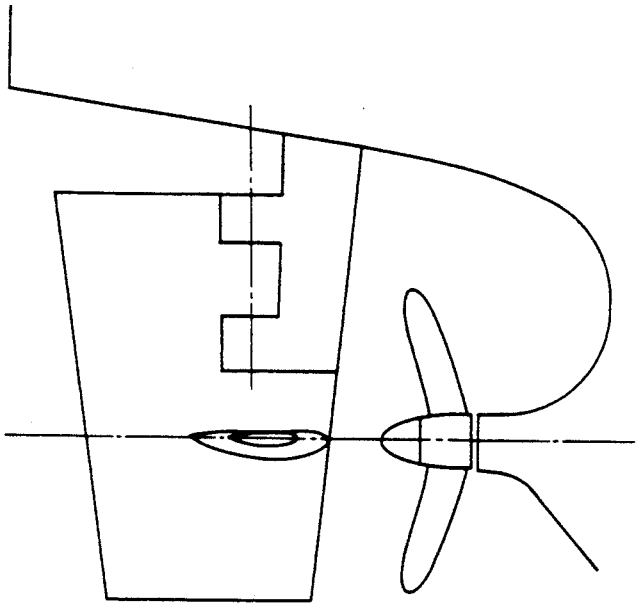
FIG. 5 (A) is an elevation showing the prior art rudder and its surrounding ship parts.
Figure 5:
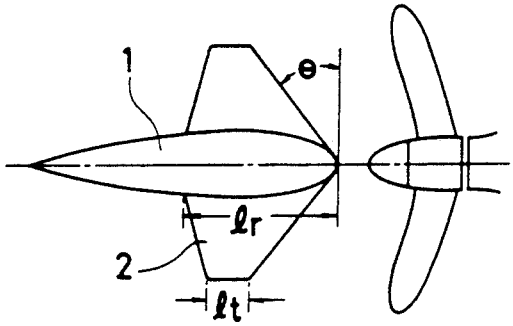
Figure 5:
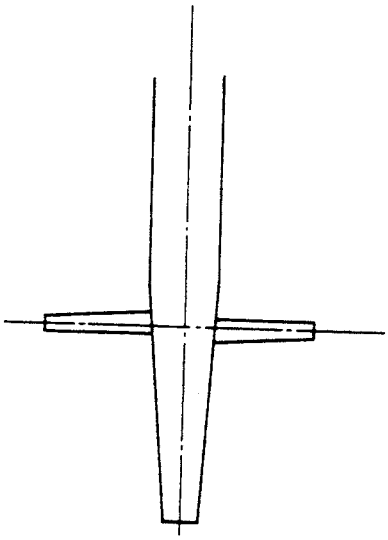
Figure 6:
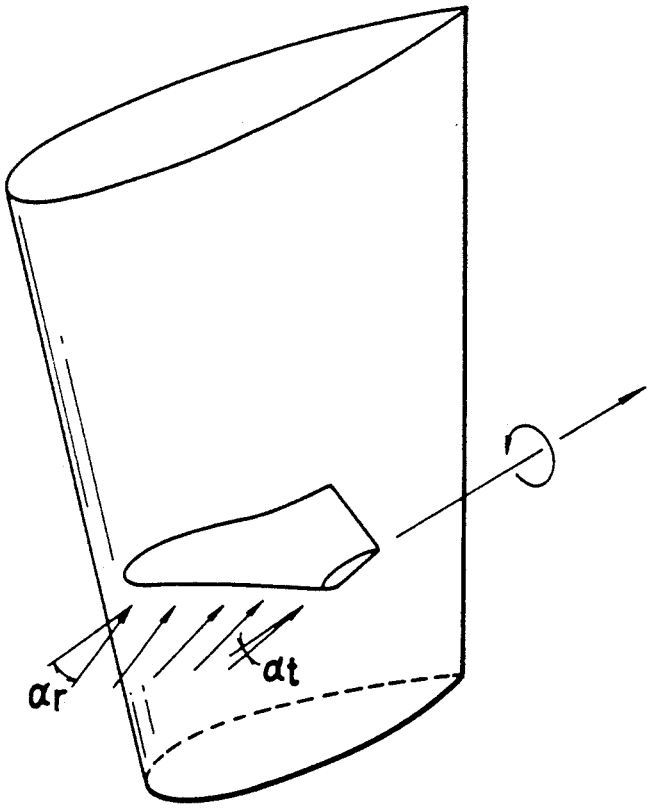
FIG. 6 is a perspective view showing the rudder of FIG. 5 and accompanying current flow.

As shown in FIG. 4, the winglets on opposite sides of the rudder can each be directed in the downward direction or in the upward direction. Further, the winglet may be divided into a front portion and a rear portion, and both the portions may be directed in the upward direction and in the downward direction respectively. The winglets can be caused to extend in both of the upward direction and the downward direction. In any of the cases, it can be expected that the thrust at the leading edge of the fin is prevented from being decreased and a new thrust at the leading edge of the fin is generated.

What is claimed is:

1. A ship's rudder, comprising:

a main rudder body having a cross-sectional shape which is streamlined and symmetrical relative to a vertical center plane of the rudder;

a pair of fins extending horizontally from opposite vertical surfaces of the rudder body, the fins being symmetrically arranged relative to the center plane of the rudder, each fin having the form of a taper fin wherein a chord length of the fin decreases from a root of the fin toward a tip of the fin, the fins having respective leading edges which coincide at the center of the main rudder body and which are located at the same level as a center line of a propeller of the ship;

the tip of each fin being provided with vertically extending winglet means wherein the winglet means of one of the fins extends only upwardly from the one fin and the winglet means of the other of said fins extends only downwardly from the other fin.

2. The rudder of claim 1, wherein each said fin has a sweepback angle of 20° to 50° along a leading edge of the respective fin and each said fin is perpendicular relative to the center plane of the rudder.

3. The rudder of claim 1, wherein said chord length at the root of each fin is at least one and a half times the chord length lt at the tip of the respective fin.

* * * * *